US006532919B2

(12) United States Patent
Curtis et al.

(10) Patent No.: US 6,532,919 B2
(45) Date of Patent: Mar. 18, 2003

(54) PERMANENT MAGNET ENHANCED ELECTROMAGNETIC VALVE ACTUATOR

(75) Inventors: Eric Warren Curtis, Milan, MI (US); Mohammad Haghgooie, Ann Arbor, MI (US); Thomas William Megli, Dearborn, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/732,839

(22) Filed: Dec. 8, 2000

(65) Prior Publication Data

US 2002/0069842 A1 Jun. 13, 2002

(51) Int. Cl.[7] ..... F01L 9/04
(52) U.S. Cl. ..... 123/90.11; 123/90.15
(58) Field of Search ..... 123/90.11, 90.15; 251/129.16, 129.01, 129.15, 129.2, 65, 129.1; 335/255, 256, 259, 265, 267

(56) References Cited

U.S. PATENT DOCUMENTS

| | | | | |
|---|---|---|---|---|
| 3,882,833 A | | 5/1975 | Longstaff et al. | |
| 4,489,863 A | | 12/1984 | Horchos et al. | |
| 4,533,890 A | | 8/1985 | Patel | |
| 4,690,371 A | | 9/1987 | Bosley et al. | |
| 4,779,314 A | | 10/1988 | Aoki | |
| 4,794,890 A | * | 1/1989 | Richeson, Jr. | 123/90.11 |
| 4,829,947 A | | 5/1989 | Lequesne | |
| 4,831,973 A | * | 5/1989 | Richeson, Jr. | 123/90.11 |
| 4,955,334 A | | 9/1990 | Kawamura | |
| 4,972,810 A | | 11/1990 | Kawamura | |
| 5,069,422 A | | 12/1991 | Kawamura | |
| 5,074,259 A | * | 12/1991 | Pusic | 123/90.11 |
| 5,095,856 A | | 3/1992 | Kawamura | |
| 5,647,311 A | * | 7/1997 | Liang | 123/90.11 |
| 6,003,481 A | * | 12/1999 | Pischinger | 123/90.11 |
| 6,182,621 B1 | * | 2/2001 | Salber et al. | 123/306 |
| 6,318,312 B1 | | 11/2001 | Bauer et al. | |

FOREIGN PATENT DOCUMENTS

| | | |
|---|---|---|
| DE | 197 12 669 A1 | 10/1998 |
| DE | 100 19 739 A1 | 11/2000 |
| EP | 0 376 716 A1 | 7/1990 |
| EP | 0 384 663 A1 | 8/1990 |
| JP | 11101110 | 4/1999 |

* cited by examiner

*Primary Examiner*—Thomas Denion
*Assistant Examiner*—Jaime Corrigan
(74) *Attorney, Agent, or Firm*—Brooks & Kushman; Carlos L. Hanze

(57) ABSTRACT

An electromagnetic valve actuator (EVA) for actuating movement of a valve in a vehicle engine includes a valve assembly operatively connected to the valve for movement therewith. The valve assembly includes a shaft connected to the valve. Two armature plates are operatively associated with the shaft, and each armature plate includes a permanent magnet. An electromagnetic coil is positioned between the two armature plates for selectively electromagnetically pushing and pulling the armature plates. Two springs are engaged with the two armature plates, respectively, for biasing the armature plates in opposing directions. The permanent magnets are operative to assist the electromagnetic coil in holding the valve in a desired position to reduce power consumption or assisting in repelling the armature for accelerating valve opening or closing.

11 Claims, 2 Drawing Sheets

PERMANENT MAGNET ENHANCED ELECTROMAGNETIC VALVE ACTUATOR

TECHNICAL FIELD

The present invention relates to an electromagnetic valve actuator having a single electromagnetic coil positioned between two magnetic armature plates for opening and closing a valve in a vehicle engine.

BACKGROUND ART

In a vehicle engine, a valve is controlled to open and close so that a cylinder may perform intake, compression, expansion, and exhaust operations.

In one example of a drive apparatus for opening and closing valves, a camshaft, which is configured by disposing cams for vale opening and closing on one shaft, is provided on the upper portion of the engine or on one side face thereof. A crankshaft, which translates the piston motion to rotational motion, and the camshaft which operates the vales are connected by means such as a belt or chain. The camshaft is driven in synchronism with the crankshaft of the engine. The valves are opened by the cam lobes on the camshaft via a link mechanism such as a rocker arm or push rod. The valve normally is held in the closed position by a spring.

In another example of a drive apparatus for opening and closing an intake exhaust valve, an intake camshaft having an intake valve opening profile, and an exhaust camshaft having an exhaust valve opening profile are disposed on the upper portion of an engine, the cam lobe of the intake camshaft pushes the axial end face other intake valve directly, and the cam lobe of the exhaust camshaft pushes the axial end face of the exhaust valve directly, thereby opening the intake/exhaust valve.

This conventional drive apparatus for opening and closing the intake/exhaust valve results in an increase in engine size because the camshaft and link mechanism must be added onto the engine. Furthermore, since the camshaft and link mechanism are driven by the output shaft (crankshaft) of the engine, some of the engine output is consumed by frictional resistance when the camshaft and link mechanism are driven. This reduces the effective output of the engine.

Further, the actuation timing of the intake/exhaust valve is fixed and cannot be altered during engine operation. Hence, the valve actuation timing is a compromise between low and high engine rpm. As a consequence, the engine output torque is not optimum neither at low nor at high engine rpm.

In order to solve the foregoing problems, various systems for driving an intake/exhaust valve to open and close the same by electromagnetic force from an electromagnet, without relying upon a camshaft, have been proposed, such as in U.S. Pat. Nos. 4,955,334 and 4,829,947, which are both hereby incorporated by reference in their entirety. These patents teach the use of a single armature plate which is movable by a pair of electromagnetic coils positioned on opposing sides of the plate.

It is desirable to provide an improved electromagnetic valve actuator design which improves opening and closing speeds of the valve, reduces power consumption required to hold the valves in open or closed positions and improves valve lift profiling.

DISCLOSURE OF INVENTION

The present invention improves upon the above-referenced prior art electromagnetic valve actuators by using a unique single coil two-plate armature design in which each armature includes a permanent magnet. This design improves opening and closing speeds of the actuators, reduces power required to hold the valves in open and closed positions, and improves valve lift profiling. These factors improve volumetric efficiency of the engine at higher speeds, reduce parasitic losses, decrease noise, and enhance durability.

More specifically, the present invention provides an electromagnetic valve actuator (EVA) for actuating movement of a valve in a vehicle engine, including a valve assembly operatively connected to the valve for movement therewith and including a shaft connected to the valve. Two armature plates are operatively associated with the shaft, and each armature plate includes a permanent magnet. An electromagnetic coil is positioned between the two armature plates for selectively electromagnetically pushing and pulling the armature plates for actuating opening and closing movement of the valve. Two springs are engaged with the two armature plates, respectively, for biasing the armature plates in opposing directions. The permanent magnets are operative to assist the electromagnetic coil in holding the valve in a desired position to reduce power consumption.

Accordingly, an object of the invention is to provide an improved electromagnetic valve actuator including a single electromagnetic coil which actuates two armature plates which each include a permanent magnet, thereby improving opening and closing speeds of the valve and reducing power consumption.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
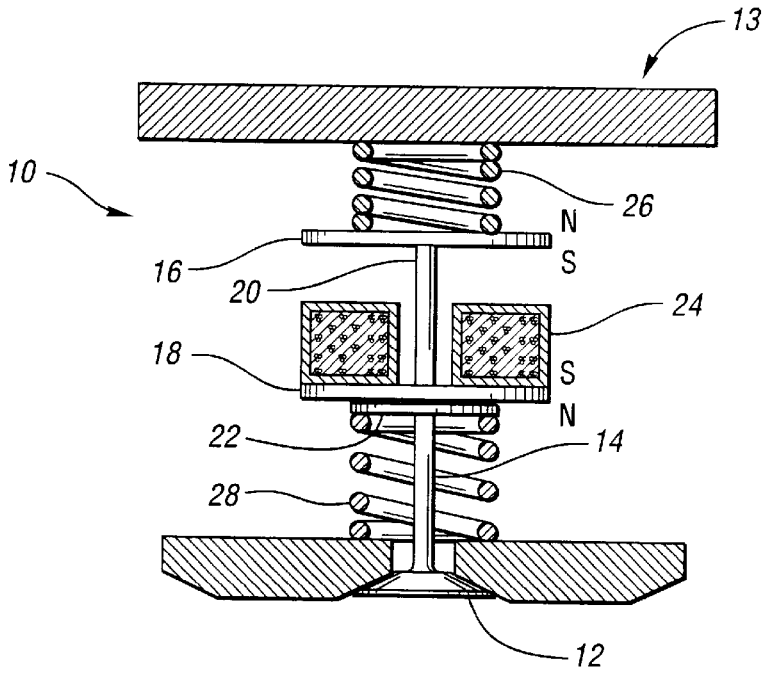
FIG. 1 shows a schematic longitudinal cross-sectional view of an electromagnetic valve actuator in accordance with the present invention, with the valve in the closed position.

Referring to FIGS. 1–5, an electromagnetic valve actuator 10 and electromagnetic coil current control scheme (FIG. 5) are shown for opening and closing a valve 12 for the vehicle engine 13.

The electromagnetic valve actuator 10 includes a valve assembly connected to the valve 12 for movement therewith. The valve assembly includes a shaft 14 and first and second armature plates 16,18 operatively associated with the shaft 14 for moving the shaft 14 and valve 12. As shown in FIG.

1, a shaft 20 connects the first and second armature plates 16,18 together, such that the second armature plate 18 is engageable with a plate 22 connected to the shaft 14, for driving the shaft 14. (The system should have "lash" between valve shaft 14 and armature 18 to ensure that the poppet valve fully seats).

Each armature plate 16,18 includes a permanent magnet, such as a permanent magnet sheet connected to a ferromagnetic plate.

An electromagnetic coil 24 is positioned between the two armature plates 16,18 for selectively electromagnetically pushing and pulling the armature plates 16,18. First and second springs 26,28 are engaged with the two armature plates 16,18, respectively, for biasing the armature plates 16,18 in opposing directions. The actuation of the EVA 10 is described below.

Figure 5:
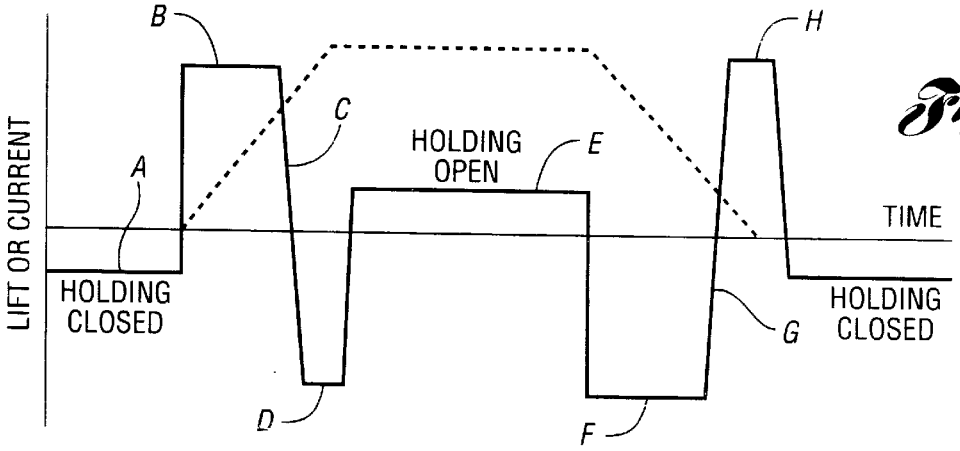
FIG. 5 shows a graphical illustration of an electromagnetic coil current control scheme to actuate opening and closing of the valve assembly of FIGS. 1–4 in accordance with the present invention.

In FIG. 1, the fixed electromagnetic coil 24 is holding the lower armature plate 18 to compress the upper spring 26. The lower spring 28 then expands to close the valve 12. The plates 16,18 use permanent magnets with a North-South (N-S, top-to-bottom) configuration in the upper plate 16 and a South-North (top-to-bottom) configuration in the lower plate 18. In this position, a negative holding current is applied to the coil 24, as shown in FIG. 5 (see "A" in FIG. 5), giving the electromagnetic coil 24 a North pole on its lower surface (as viewed in FIG. 1), thereby enhancing the closing force by pulling on the South pole of the lower armature plate 18. This ultimately reduces the electrical power required to hold the valve 12 in the closed position, and therefore reduces fuel consumption.

Figure 2:
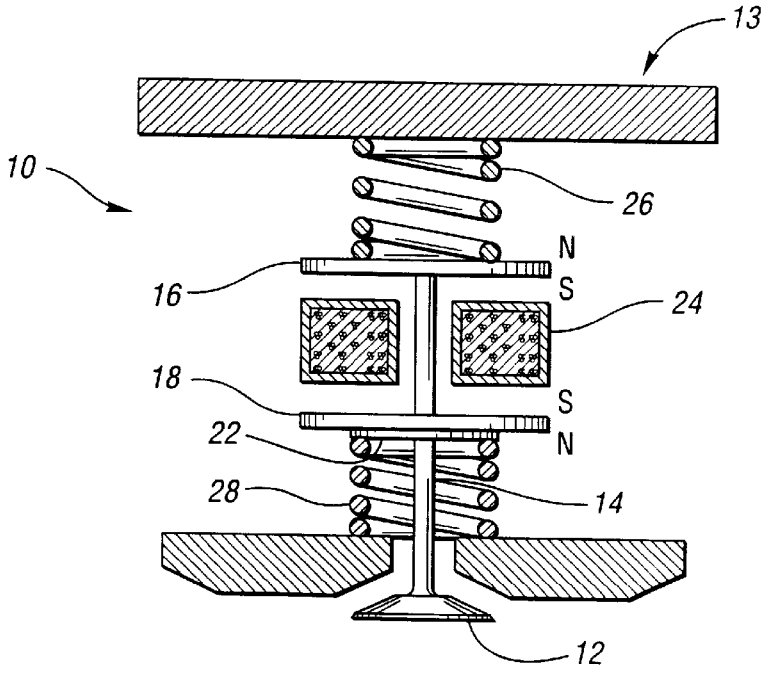
FIG. 2 shows a schematic longitudinal cross-sectional view of the electromagnetic valve actuator assembly of FIG. 1, with the valve opening.

Referring to FIG. 2, when the valve opens, the current in the electromagnetic coil 24 is reversed (see "B" in FIG. 5) so that the electromagnet 24 has South pole on its lower surface. This creates an opposing force between the electromagnet and the lower armature plate 18 which supplements the opening force normally provided by the upper spring 26. Additionally, the positive coil current creates an attractive force between the North pole of the upper surface of the electromagnet 24 and the South pole of the upper armature plate 16. This increases the opening speed of the valve 12, and therefore improves the volumetric efficiency of the engine at higher speeds. As the valve approaches the full open position, the current is reduced (see "C" in FIG. 5) to minimize the closing force and soften the landing of the upper armature plate 16 on the coil 24. If the armature speed and inertia are high, a negative current (see "D" in FIG. 5) may be applied to the coil 24 for a short time to further reduce the landing velocity (to levels below that possible for an armature without permanent magnets).

Figure 3:
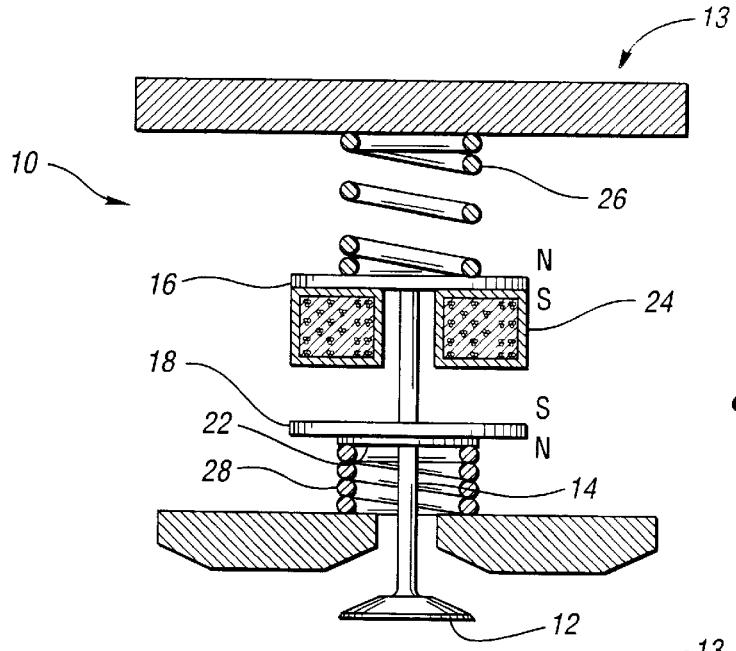
FIG. 3 shows a schematic longitudinal cross-sectional view of the electromagnetic valve actuator of FIG. 1, with the valve in the open position.

Referring to FIG. 3, when the valve reaches the fully open position, the current is held at a positive level (see "E" in FIG. 5) where the magnetic forces balance the spring forces. Again, the permanent magnet enhances the force and therefore reduces the electrical power required to hold the valve 12 open.

Figure 4:
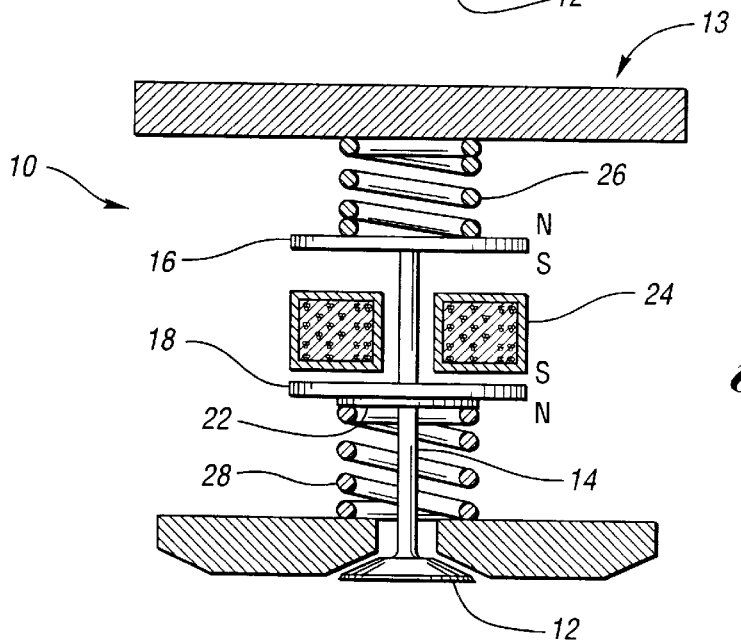
FIG. 4 shows a schematic longitudinal cross-sectional view of the electromagnetic valve actuator of FIG. 1, with the valve closing.

Referring to FIG. 4, the valve closing process is similar to the opening process. The coil current is reversed (see "F" in FIG. 5) to create a South pole on the upper surface of the electromagnet 24 (as viewed in the Figures). This repels the South pole of the upper armature plate 16. The North pole on the lower surface of the coil 24 attracts the South pole on the lower armature plate 18. The additional attractive and repulsive forces created by the permanent magnets supplement the closing force provided by the lower spring 28. As the valve approaches the full closed position, the current magnitude is reduced (see "G" in FIG. 5) to minimize the closing force and soften the landing of the upper armature plate 16 on the coil 24. If the armature speed and inertia are high, a positive current (see "H" in FIG. 5) may be applied for a short time to further reduce the landing velocity.

The above-described control scheme is shown in FIG. 5. The dashed line indicates valve position, and the solid line indicates the current through the electromagnetic coil 24.

While the best mode for carrying out the invention has been described in detail, those familiar with the art to which this invention relates will recognize various alternative designs and embodiments for practicing the invention within the scope of the appended claims.

What is claimed is:

1. Method of controlling movement in an engine of a valve having an associated shaft, the method comprising:

providing first and second armature plates on the valve shaft so as to define a gap between said first and second plates, said plates each including a permanent magnet and each abutting against a spring;

energizing an electromagnetic coil positioned in the gap between the plates to selectively push and pull the plates to effect opening and closing movement of the valve.

2. The method of claim 1, wherein said energizing step comprises providing a negative current to bias the plates in one direction, and a positive current to bias the plates in an opposite direction.

3. The method of claim 2, wherein said energizing step further comprises reducing current to the coil as the valve approaches a landing to minimize closing force and soften landing.

4. The method of claim 3, further comprising reversing current for a short period of time as the valve approaches a landing to further reduce landing velocity.

5. The method of claim 1, further comprising reducing current for holding the valve in open and closed positions by utilizing the permanent magnets to assist in holding the valve in open and closed positions.

6. The method of claim 1, further comprising configuring said permanent magnets so that like poles of each magnet faces the coil.

7. An electromagnetic valve actuator for actuating movement of a valve in a vehicle engine, the actuator comprising:

a valve assembly operatively connected to the valve for movement therewith and including a shaft connected to the valve, with two armature plates on the shaft so as to define a gap therebetween, each said armature plate including a permanent magnet;

an electromagnetic coil positioned in the gap between the two armature plates for selectively electromagnetically pushing and pulling the armature plates; and two springs engaged with the two armature plates, respectively, for biasing the armature plates in opposing directions;

wherein said permanent magnets are operative to assist the electromagnetic coil in holding the valve in a desired position to reduce power consumption.

8. The actuator of claim 7, wherein said electromagnetic coil is further operative to control braking of the valve by reversing polarity of the coil to reduce valve landing speed at open and closed positions.

9. The actuator of claim 8, wherein said permanent magnets comprise permanent magnet sheets connected to ferromagnetic plates.

10. The actuator of claim 7, wherein each magnet is arranged such that like poles face the electromagnetic coil.

11. An electromagnetic valve actuator for actuating movement of a valve in a vehicle engine, the actuator comprising:

a valve assembly operatively connected to the valve for movement therewith and including a shaft connected to the valve, with two armature plates on the shaft in a spaced relation to thereby define a gap therebetween, each said armature plate including a permanent magnet;

an electromagnetic coil positioned in the gap between the two armature plates for selectively electromagnetically pushing and pulling the armature plates for opening and closing the valve; and two springs engaged with the two armature plates, respectively, for biasing the armature plates in opposing directions;

wherein said permanent magnets are operative to assist the electromagnetic coil in holding the valve in a desired position to reduce power consumption, and the electromagnetic coil is further operative to control braking of the valve by reversing polarity of the coil to reduce valve landing speed at open and closed positions.

* * * * *